US011015512B2

(12) United States Patent
Elsasser et al.

(10) Patent No.: US 11,015,512 B2
(45) Date of Patent: May 25, 2021

(54) LINE ELEMENT FOR COMPENSATING FOR EXPANSIONS AND/OR RELATIVE MOVEMENTS

(71) Applicant: Witzenmann GmbH, Pfrozheim (DE)

(72) Inventors: Alexander Elsasser, Konigsbach-Stein (DE); Nadine Hanakam, Pforzheim (DE); Jorg Ludwig, Pforzheim (DE); Daniel Rotfuss, Straubenhardt (DE); Thorsten Zohm, Karlsruhe (DE)

(73) Assignee: Witzenmann GmbH, Pforzheim (DE)

( * ) Notice: Subject to any disclaimer, the term of this patent is extended or adjusted under 35 U.S.C. 154(b) by 120 days.

(21) Appl. No.: 15/900,890

(22) Filed: Feb. 21, 2018

(65) Prior Publication Data

US 2018/0238222 A1 Aug. 23, 2018

(30) Foreign Application Priority Data

Feb. 21, 2017 (DE) ..... 102017103551.6

(51) Int. Cl.
*F16L 11/00* (2006.01)
*F01N 13/18* (2010.01)
*F01N 3/021* (2006.01)

(52) U.S. Cl.
CPC ..... *F01N 13/1816* (2013.01); *F01N 3/021* (2013.01)

(58) Field of Classification Search
CPC ..... F01N 13/1816; F01N 3/021; F16L 11/15; F16L 11/18
USPC ..... 138/121, 122, 120, 119, 135, 136
See application file for complete search history.

(56) References Cited

U.S. PATENT DOCUMENTS 899,623 A * 9/1908 Royer ..... F16L 27/111 285/114
919,001 A * 4/1909 Greenfield ..... F16L 11/16 138/131
1,215,365 A * 2/1917 Gilson ..... H01B 7/226 138/131
2,045,540 A * 6/1936 Debenedetti ..... B29D 23/001 156/143
3,204,666 A * 9/1965 Lindsay ..... F16L 11/16 138/135
3,908,703 A * 9/1975 Bournazel ..... F16L 11/083 138/120
5,145,215 A * 9/1992 Udell ..... F01N 13/1816 285/226

(Continued)

FOREIGN PATENT DOCUMENTS

DE 20017036 12/2001
DE 10340983 9/2004

*Primary Examiner* — James F Hook
(74) *Attorney, Agent, or Firm* — Volpe Koenig

(57) ABSTRACT

A line element for compensating for expansions and/or relative movements within a line through which fluid can flow, comprising a ring-corrugation or helical-corrugation bellows 1 and a hose 3, which is arranged coaxially in the interior of the bellows 1 and is made of a dimensionally stable material, for flow-guidance purposes. The hose 3 has a number of individual, essentially dimensionally stable ring-form hose elements 4 which are plugged axially one inside the other so as to be retained such that they can be moved axially and/or angularly in relation to one another between a compressed position and an extended position. A method for producing such a line element is also provided.

17 Claims, 6 Drawing Sheets

(56) References Cited

U.S. PATENT DOCUMENTS 5,259,418 A * 11/1993 Hamrick ..... B29B 13/024 116/207
5,639,127 A * 6/1997 Davey ..... F01N 13/1811 285/226
5,865,378 A * 2/1999 Hollinshead ..... E03C 1/021 239/587.1
6,192,941 B1 * 2/2001 Mallen-Herrero ..... F16L 11/16 138/135
6,612,342 B2 9/2003 Godel et al.
6,848,478 B2 * 2/2005 Nagai ..... F01N 13/1816 138/112
6,921,112 B2 * 7/2005 Atansoski ..... F01N 13/1811 285/226
2003/0184086 A1 * 10/2003 Christianson ..... E03C 1/06 285/146.1
2004/0154677 A1 * 8/2004 Coutarel ..... F16L 11/083 138/135
2005/0011573 A1 * 1/2005 Chahine ..... F01N 13/1816 138/148
2006/0162799 A1 * 7/2006 Goddard ..... F16L 11/15 138/121
2008/0012297 A1 1/2008 Heil et al.
2011/0073209 A1 * 3/2011 Eguchi ..... F01N 13/1816 138/121
2011/0232796 A1 * 9/2011 Weiss ..... F01N 13/1816 138/120
2012/0112452 A1 * 5/2012 Stalcup, II ..... F01N 13/1816 285/145.5
2012/0279606 A1 * 11/2012 Teso, Jr. ..... F01N 13/14 138/140
2013/0056105 A1 * 3/2013 Graham ..... F16L 11/083 138/120
2013/0105026 A1 * 5/2013 Biaggi ..... F16L 11/115 138/121
2019/0309876 A1 * 10/2019 Dong ..... F01N 13/18

* cited by examiner

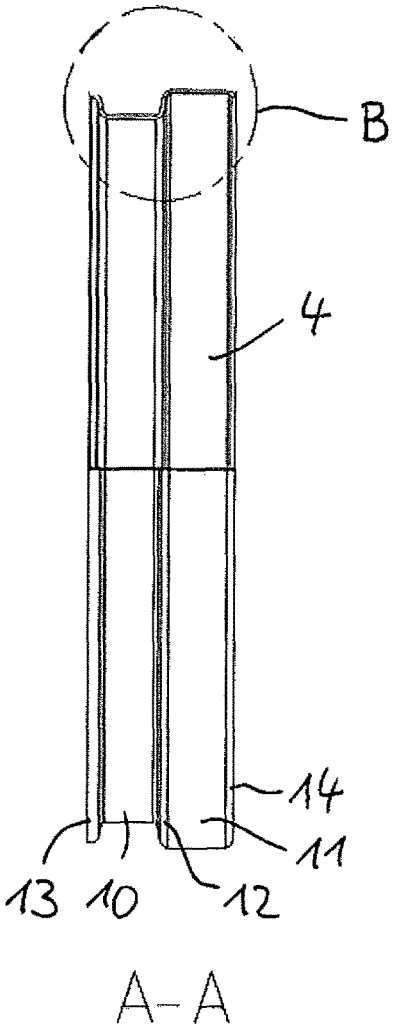
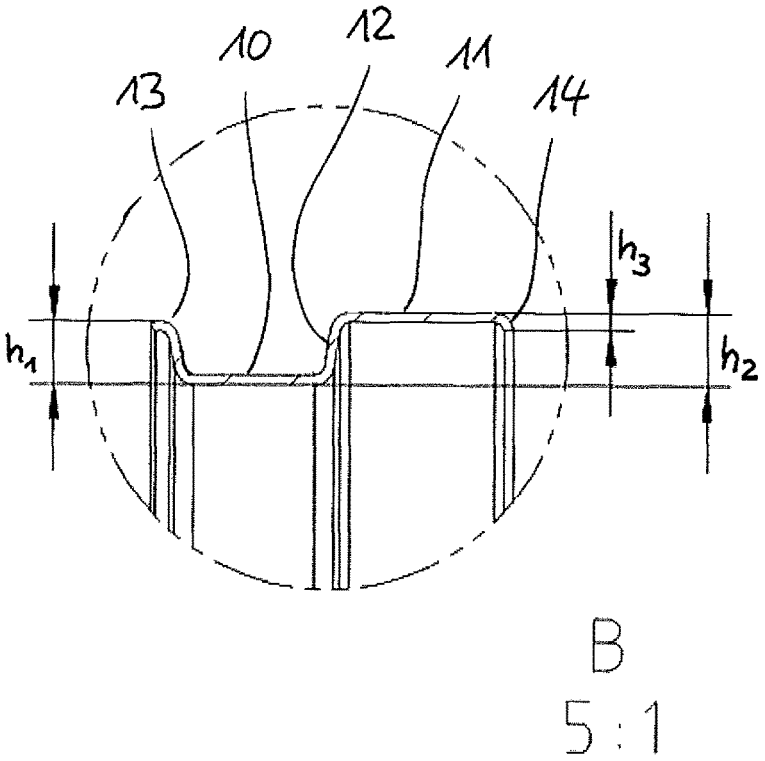
Fig. 5
Fig.6

LINE ELEMENT FOR COMPENSATING FOR EXPANSIONS AND/OR RELATIVE MOVEMENTS

INCORPORATION BY REFERENCE

The following documents are incorporated herein by reference as if fully set forth: German Patent Application No. 10 2017 103 551.6, filed Feb. 21, 2017.

BACKGROUND

The present invention relates to a line element for compensating for expansions and/or relative movements within a line through which fluid can flow.

A line element of the present type comprises a ring-corrugation or helical-corrugation bellows and a hose, which is arranged coaxially in the interior of the bellows and is made of a dimensionally stable material, for flow-guidance purposes.

Lines through which fluid can flow, in particular those provided for fluids of which the temperature deviates to a pronounced extent from the ambient temperature, are usually produced from dimensionally stable materials such as, in particular, metals. In order to compensate for expansions and/or relative movements within the line, it is therefore necessary for the pipe to have installed in it movable line elements which yield to operation-induced angling and changes in length and thus compensate for the same without compromising the sealing of the line.

Bellows, in particular metal bellows, with ring corrugations or helical corrugations have been known for this purpose for some time now. The movement capability of such a bellows is based on the bending elasticity of the corrugation flanks, wherein the distance between corrugations under bending load increases on the outside curve and shortens on the inside curve. In the case of changes in length, the distance between corrugations increases or shortens symmetrically. The corrugation formation therefore ensures the desired movement capability of the bellows, the wall not being interrupted at any point and therefore the fluid tightness of the bellows corresponding to the fluid tightness of a smooth pipeline of the same material and of the same wall thickness.

In order for fluids which, in particular due to their temperature, are problematic for the movement properties or the service life of a bellows, to be directed through such a bellows, and/or in order to guide the fluid flow and to prevent the situation where the fluid swirls around the corrugations of the bellows, line elements of the present type have a hose made of a dimensionally stable material arranged in the interior of the bellows. This hose guides the flow, smoothes the boundary layers thereof and protects the bellows, if appropriate, against thermal loading.

Such a hose is likewise usually produced from metal and, since it is arranged within a bellows and serves only for flow-guidance purposes, does not have to meet any particular sealing-related requirements. In line elements of the present type, use is therefore usually made of strip-wound hoses which comprise a profiled, helically wound metal strip with peripheries which engage in a movable manner one inside the other.

It is possible here for the windings of the wound metal strip to be hooked one inside the other and to have an essentially S-shaped hook profile. This profile allows the individual windings to be retained such that they can be moved axially and/or angularly in relation to one another between a compressed position and an extended position. A strip-wound hose with a hook profile is highly capable of movement, but has an only very limited degree of sealing. It is also the case that this design dictates limited resistance to mechanical overstressing by tensile forces and torsional movements.

Strip-wound hoses with an interlocked profile forming loosely interlocked winding meet relatively stringent requirements relating to sealing and mechanical strength. The interlocked profile forms a form fit in the radial direction between the individual windings of the strip-wound hose and, as a result, is more resistant to tensile loading and torsional loading. The sealing is also improved. On the other hand, however, the movement capability of the strip-wound hose suffers when the latter comprises an interlocked profile, and the frictional surfaces produced as a result of the interlocking give rise to a significant level of internal friction for the strip-wound hose during movement. In some applications, this is desirable in order to damp, in particular, oscillation. Depending on the application, however, it is also possible for the internal friction of an interlocked profile to be undesirable.

All strip-wound hoses have in common the internal stressing in the profile which forms the windings, internal stressing occurring when the profile is wound. Such internal stressing may result in increased wear during operation, which obviously limits the service life of the line element.

Strip-wound hoses also have the disadvantage that they have to be cut to the required length, and this, on account of the helical windings, usually results in the formation of burrs. In particular when use is made of a line element of the present type in the exhaust system of a motor vehicle, to be precise in particular when the line element is arranged upstream of an emission-control device, in particular upstream of a particulate filter for exhaust gases from a diesel engine, it is necessary to meet cleanliness requirements, which have to be maintained even in the case of pronounced temperature fluctuations. In the vicinity of an engine, it is possible for exhaust-gas temperatures to reach around 600° C. In order to meet such cleanliness requirements, it has been necessary, up until now, to use high-outlay follow-up machining work to remove burrs from cut-off strip-wound hoses.

In order for a line element for compensating for expansions and/or relative movements within a line through which fluid can flow to be produced more cost-effectively, use is sometimes made, within the bellows, of a smooth pipe for flow-guidance purposes, said pipe being connected to the bellows or the pipeline only at one end, that is to say upstream, and remaining free at the other end. In order nevertheless to prevent such a smooth pipe from striking against the inner side of the bellows in the case of lateral or angular deflection, the smooth pipe has to be provided with a significantly reduced inner cross section, which clearly disadvantageously reduces the flow cross section.

SUMMARY

The object of the present invention is therefore that of improving a line element of the type mentioned in the introduction by using a hose, for flow-guidance purposes, which, along with an optimized flow cross section, has movement capability and a thermal decoupling action which are not reduced in relation to conventional strip-wound hoses, enhanced cleanliness requirements nevertheless being met, and of providing a method for producing such a line element.

This object is achieved by a line element as well as a method having one or more features of the invention. Preferred configurations and developments of the line element and method according to the invention can be found below and in the claims.

Accordingly, in the first instance, a line element according to the invention for compensating for expansions and/or relative movements within a line through which fluid can flow comprises, in a conventional manner, a ring-corrugation or helical-corrugation bellows and a hose, which is arranged coaxially in the interior of the bellows and is made of a dimensionally stable material, for flow-guidance purposes. According to the invention, however, rather than comprising a wound profile, the hose comprises a number of individual, essentially dimensionally stable ring-form hose elements which are plugged axially one inside the other so as to be retained such that they can be moved axially and/or angularly in relation to one another between a compressed position and an extended position. Limiting the axial movement capability between a compressed position and an extended position prevents the situation where the individual hose elements fall apart when the hose is extended or slide too far into one another when the hose is compressed.

The amount of axial play present between the compressed position and the extended position preferably provides for both an axial change in length of the hose and angular and lateral movement capability, wherein the bending capability of the hose which is necessary for the angular and lateral movement capability is produced by oppositely directed axial movements on radially opposite sides of the hose elements: on the inside curve, the hose elements are pushed together in the direction of the compressed position, whereas, on the outside curve, they are pulled axially apart from one another in the direction of the extended position.

Constructing a flexible hose from dimensionally stable ring-form hose elements makes it possible for the axial movement capability and the angular/lateral movement capability to be adjusted independently of one another. In addition, it is also possible for the fluid tightness and the internal friction of the hose to be designed largely independently of one another. Finally, there is no need for such a plugged-together hose to be cut to the desired length, and it therefore meets enhanced cleanliness requirements even in the event of high temperature loading. It is even possible for the individual hose elements to be produced, for example, in a clean room, in particular also without lubricants being used, so that maximum cleanliness requirements are met.

According to the invention, it is preferred for such a hose, which comprises a number of individual, essentially dimensionally stable ring-form hose elements which are plugged axially one inside the other so as to be retained such that they can be moved axially and/or angularly in relation to one another between a compressed position and an extended position, to be used in an exhaust system of a combustion engine.

It is further preferred for this hose to be used within an expansion-compensation body in the exhaust system of a combustion engine, wherein the expansion-compensation body is arranged between the combustion engine and an emission-control device, in particular a particulate filter.

In particular, in the case of these preferred uses of the line element according to the invention, or of the hose thereof, it is preferred if the hose elements are produced from metal, in particular with a material thickness between 0.1 mm and 0.4 mm. It is likewise expedient if the bellows is a metal bellows having, in particular, 2 to 15 corrugations, preferably 5 to 8 corrugations. Accordingly, the hose is made up preferably of at least 3 and at most 20 hose elements. These are optimal geometries for use of the line element as an expansion-compensation body in the exhaust system of a combustion engine, in particular between the combustion engine and an emission-control device.

The hose elements are preferably plugged one inside the other by being radially widened and/or radially pushed together, due to inherent elasticity, so as to achieve a kind of axial form fit in which the mutually facing ends of the hose elements engage behind one another or interlink with one another to form a pull-out prevention means. The hose elements according to the invention are essentially dimensionally stable, i.e. they resist a change in shape to such an extent that they cannot be moved axially beyond the compressed position or beyond the extended position, as long as they are subjected to intended forces when the line element is being used as intended. In contrast, within the context of the present invention, deformation of the hose elements by joining forces which are effected during production of the line element, rather than being ruled out, is usually desirable.

It is possible for the hose elements of the line element according to the invention to have a closed circumference or else to be easily opened at their circumference. The latter case makes it easier for the hose elements to be plugged together when the hose is being produced.

According to the invention, the hose elements are of ring-form configuration, although this does not mean that they always have to be circular. Rather, it is possible for the ring form to be circular or elliptical, oval or stadium-shaped or flattened in some other way or even provided with constrictions.

An advantageous development of the line element according to the invention can include providing two different groups of hose elements which have different ring shapes and of which the hose of the line element according to the invention is made up. This may be implemented, for example, such that a first group of hose elements has a circular ring shape, whereas a second group of hose elements has a non-circular ring shape, in particular an oval ring shape. This provides advantages, in particular, when the hose is made up of hose elements which belong alternately to the first and the second group of hose elements. This is because this provides for novel effects in the relative movement of the hose elements in relation to one another, in particular in respect of a desired internal friction of the hose made up alternately from such hose elements.

In the case of the preferred use of the line element according to the invention in the exhaust system of a combustion engine, making up the hose alternately from hose elements of different ring shapes prevents the situation where the hose elements cause rattling in the event of vibrations and disadvantageous deflections occurring.

The same effect can be achieved by a further advantageous configuration of a hose of a line element according to the invention, in which case in each case two adjacent hose elements are interlinked with one another at at least one point of their circumference. This can take place by deformation or pressing action at a certain point once the hose elements have been plugged together.

The clearance is preferably present between the hose of the line element according to the invention, said hose comprising a number of ring-form hose elements, and the bellows, which is arranged coaxially outside the hose, and therefore, when the line element moves as intended, these two components are prevented from coming into contact or even striking against one another. At the same time, the clearance ensures improved thermal decoupling of the bellows from the fluid, of which the flow is guided in the hose.

Since the hose is produced according to the invention from a number of individual ring-form hose elements, the movement capability of the hose can be pre-set very accurately, and therefore, when there is only a small amount of installation space present, the clearance between the hose and the bellows may be selected, if appropriate, to be very small, in order to ensure a nevertheless maximum flow cross section for the fluid directed through.

As is known per se for line elements of the present type, it is also possible, in the case of the line element according to the invention, to provide for the bellows, at each of its axial ends, to have a flange, on which the hose is fastened directly or indirectly. If a clearance is provided, at the same time, between the hose and the bellows, it is expediently the case that, in the region of the flanges of the bellows, the hose has a respective hose element which is designed in the form of an end piece and has an enlarged radial extent. It is thus possible for these enlarged hose elements to be fastened directly on the bellows.

The hose elements of which the hose of the line element according to the invention are made up preferably have, in axial sequence, a first sub-portion and a second sub-portion, which are connected by a transition portion. The first sub-portion here has a radially smaller extent than the second sub-portion. If such line elements are plugged together in the same axial direction, the first sub-portion of a first hose element can be plugged into the second sub-portion of a second hose element in order to make up the hose.

In order to form an axial pull-out prevention means, and to define the extended position between two ring-form hose elements, it is preferred if, at its end which is directed away from the second sub-portion, the first sub-portion is provided with a radially widened, first end portion, whereas, at its end which is directed away from the first sub-portion, the second sub-portion has a second end portion of reduced radial extent. The radial extents of the first and second end portions are then selected such that the first and second end portions of two hose elements plugged one inside the other engage behind one another in the axial direction, and thus form a kind of axial form fit, in order to produce the axial pull-out prevention means and to define the extended position.

In order to form an axial stop, in order to define the compressed position between two ring-form hose elements, it is preferred if the radial extents of the first and second end portions are selected such that the first and second end portions of two hose elements plugged one inside the other overlap with the transition portion, as seen in axial projection. As a result, the transition portion forms an axial stop when the two hose elements are pushed together and thus defines the compressed position.

It is preferred here if the first sub-portion and/or the second sub-portion of the hose elements are/is cylindrical. This shape works best in combination with the desired axial movements between the compressed position and the extended position and, along with appropriate dimensioning, also provides for tilting of two hose elements in relation to one another, the hose elements on one side being moved into the compressed position and those on the opposite side being moved into the extended position. This results in angular and lateral movement capability of the modular hose.

It is also preferred here if the first and second end portions of the ring-form hose elements are essentially radially running angled sections of the first and second sub-portions, this ensuring straightforward and efficient production of the correspondingly designed hose elements.

Therefore, in particular due to the modular plug-in construction of the hose arranged in the interior of the bellows, the present invention makes it possible for the movement capability of the hose to be adjusted to predefineable set-point values, so that it is possible, along with a predetermined minimum level of thermal decoupling between the fluid flow and the bellows, to provide an optimum flow cross section. It is also possible here to take into account a third parameter, which is based on avoidance of contact between the hose and the bellows when the line element is being used as intended.

In addition, the modular plug-in design of the hose also makes it possible to pre-set possibly desired damping properties on account of internal friction and to largely pre-set the leakage behavior of the finished hose.

Finally, producing the hose as a plug-in construction means that there are no problems relating to cleanliness requirements, even if fluids at high temperatures, for example exhaust gases from a diesel engine, which may reach temperatures up to 600° C., are directed through the line element.

The method according to the invention for producing such a line element comprises at least the following method steps: first of all, a number of individual, essentially dimensionally stable ring-form hose elements are provided, it being possible for said hose elements to be plugged axially one inside the other so as to be retained such that they can be moved axially and/or angularly in relation to one another between a compressed position and an extended position. Thereafter, the ring-form hose elements are widened at one of their axial end regions in order for them to be plugged one inside the other in an axially successive row, in which they are retained such that they can be moved axially and/or angularly in relation to one another between a compressed position and an extended position, to form a hose. Finally, said hose made up of the ring-form hose elements is introduced into a ring-corrugation or helical-corrugation bellows and secured there.

The radial widening of the ring-form hose elements usually takes place such that the hose elements are merely elastically widened and, once the plurality of hose elements have been plugged one inside the other, return essentially to their starting shape again. This means that the hose elements can form a form fit in relation to one another, as seen in the axial direction, as a result of which the axial movement capability between the compressed position and the extended position can be limited by corresponding stops, which define the compressed position and the extended position.

As an alternative to elastic widening of the hose elements, however, it is also possible for plastic widening of the hose elements to take place, use being made of hose elements which are plastically deformed during widening and thus achieve an axially and/or angularly movable form fit between the compressed position and the extended position. This can take place, for example, such that radially outwardly oriented angled sections are introduced into the hose elements, by way of which said hose elements, as seen in the axial direction, achieve a form fit with radial surfaces of the adjacent hose elements and preferably form stop surfaces for defining the compressed position and the extended position.

In order to prevent, in particular, rattling during operation of a line element according to the invention, in particular during the preferred use of the line element in the exhaust system of a motor vehicle, it is possible, within the context of the method according to the invention, during or after the plug-in operation, for in each case two adjacent ring-form hose elements to be interlinked with one another at at least one point of their circumference by plastic deformation or pressing action.

BRIEF DESCRIPTION OF THE DRAWINGS

An exemplary embodiment for a line element configured according to the invention will be explained and described in more detail hereinbelow with reference to the accompanying drawings, in which:

FIG. 5 shows a sectional illustration taken along line A from FIG. 4;

FIG. 6 shows the detail B from FIG. 5;

DETAILED DESCRIPTION OF THE PREFERRED EMBODIMENTS

Figure 1:
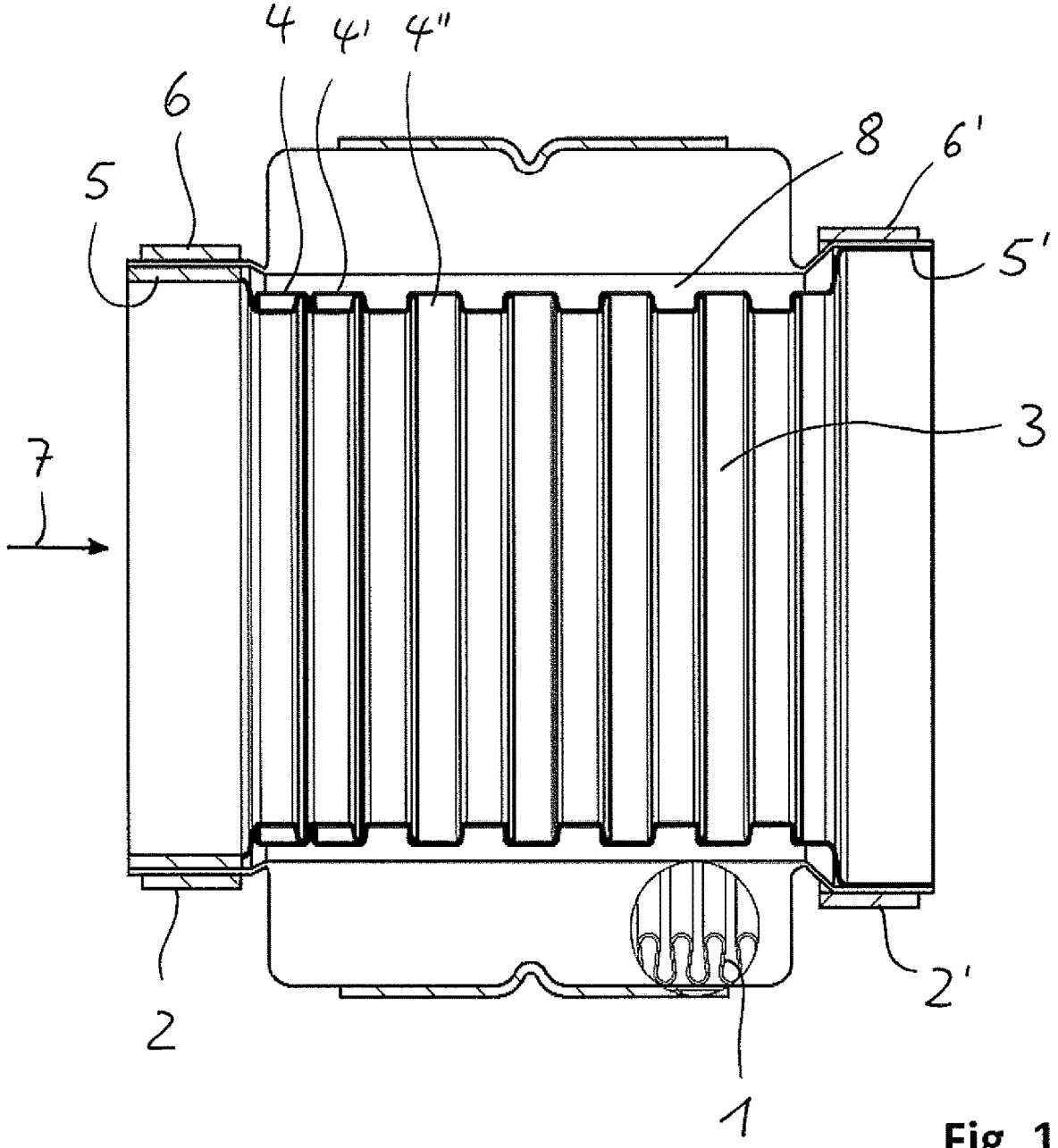
FIG. 1 shows a lateral sectional illustration of a line element configured according to the invention.

FIG. 1 shows a lateral sectional illustration of a line element configured according to the invention for the purpose of compensating for expansions and/or relative movements, wherein the present exemplary embodiment is an expansion body for the exhaust system of a motor vehicle with a diesel engine. The expansion body serves there to compensate for thermal expansions, relative movements within the exhaust-gas line and, if appropriate, installation tolerances; for this purpose, it is installed in the exhaust system in the vicinity of the engine and is also located upstream of the emission-control devices.

Said line element, designed in the form of an expansion body, essentially comprises a ring-corrugation bellows 1 which is made of stainless steel and, at each of its axial ends, has a flange 2, 2'. A hose 3 configured according to the invention is arranged coaxially within the bellows 1, said hose 3 likewise consisting of stainless steel and being made up of a number of individual, ring-form hose elements 4, 4', 4". Provided in the region of the flanges 2, 2' of the bellows 1 are two hose elements which are designed in the form of end pieces 5, 5', have an enlarged radial extent in relation to the other hose elements 4, 4', 4" and therefore extend up to, and onto, the flanges 2, 2' of the bellows 1. They are welded there to the flanges 2, 2' and a respective sleeve 6, 6', and this therefore establishes a fixed connection between the hose 3 and the bellows 1 at both axial ends of the line element.

The hose elements 4, 4', 4" can move axially relative to one another, limitation being provided by a compressed position and an extended position, wherein the two hose elements 4, 4' arranged on the left-hand side of the illustration are located in the compressed position, whereas the rest of the hose elements 4" are located in an extended position in relation to one another. The axial movement capability, moreover, makes it possible for two hose elements to tilt (not illustrated here) in relation to one another, which all results in axial and lateral movement capability of the hose 3.

In accordance with the use purpose, the line element illustrated in FIG. 1 is of relatively short design, although it has a large cross section for the fluid flow indicated by an arrow 7. The line element has the axially short construction owing to the merely small amount of installation space available in the exhaust system in the vicinity of the engine. In order to ensure the desired movement capability of the line element even in the case of small axial dimensionings, the bellows 1 is provided with only small wall thicknesses, and it has deep corrugations. Accordingly, it is necessary for the bellows 1 to be shielded, in particular, thermally from the fluid flow 7, which may be at temperatures of around 600° C. The thermal shielding takes place by way of the flow-guiding hose 3 and an insulating-action clearance 8 between the hose 3 and the bellows 1. The plugged-together design of the hose 3 nevertheless gives the latter a large flow cross section, without there being any risk of it coming into undesirable contact with the bellows 1 in the case of lateral and/or angular movements, or on account on oscillating movements.

Moreover, the hose elements 4, 4', 4" plugged one inside the other mean that there is no need for the hose 3 to be cut to length in order to be installed in the bellows 1, so that there is no risk of any burr formation and the cleanliness requirements for the envisaged use purpose can be met without the hose 3 being subjected to any high-outlay follow-up machining.

Figure 2:
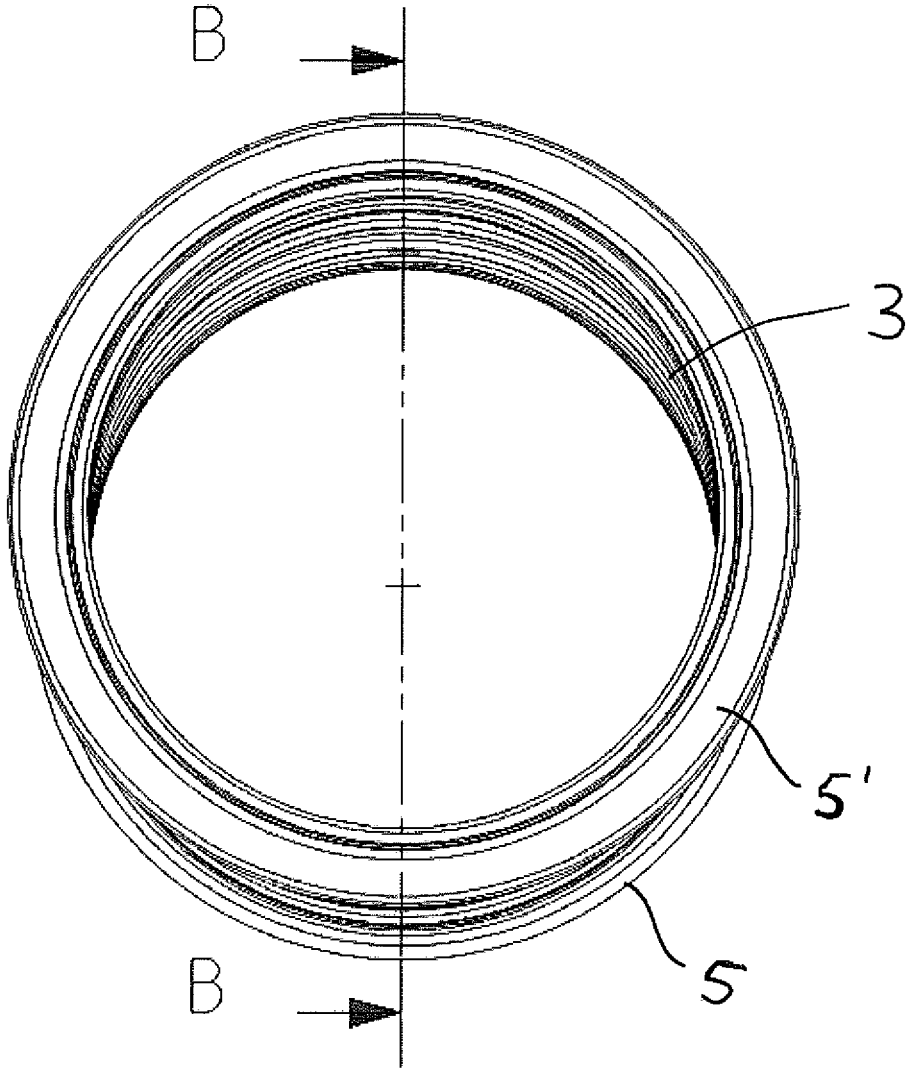
FIG. 2 shows a view of the hose from the line element from FIG. 1.
Figure 3:
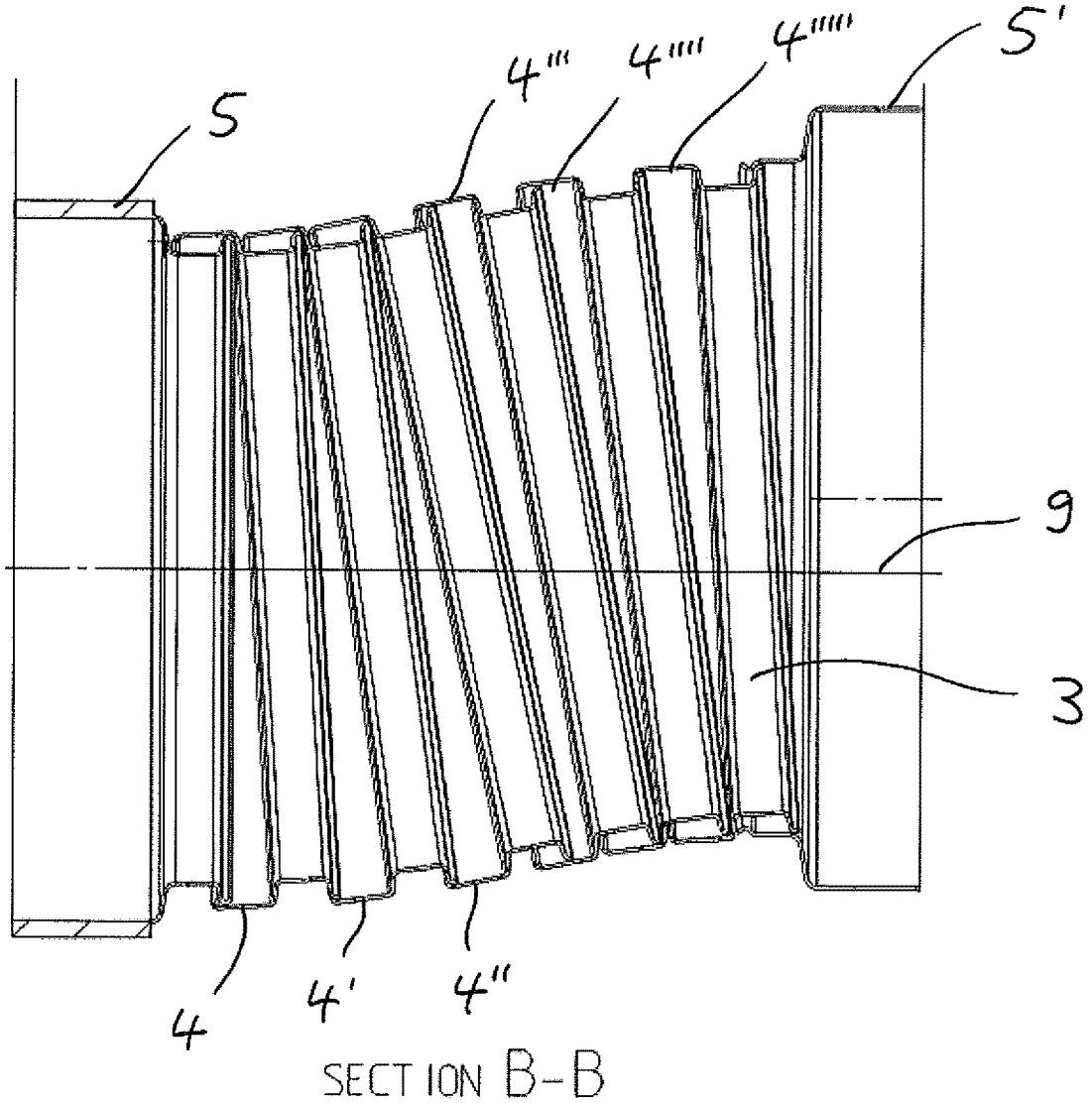
FIG. 3 shows a section taken along line B-B from FIG. 2.

FIG. 2 shows an axial view of the hose 3 from FIG. 1, while FIG. 3 is a sectional illustration taken along line B-B from FIG. 2.

As, in particular, FIG. 3 shows clearly, the hose 3 illustrated here has been deflected laterally in relation to a hose axis 9, three hose elements 4, 4', 4" having been tilted upward in each case, whereas three other hose elements 4''', 4'''', 4''''' have been tilted down in the opposite direction. Three hose elements each here, on the side illustrated at the top and bottom in FIG. 3, are located in the compressed position, whereas they are illustrated in the extended position on the opposite side.

The two end pieces 5, 5', which are radially enlarged in relation to the rest of the hose elements 4, 4', 4", etc., are likewise retained in an axially (and, to this extent, also angularly) movable manner on their adjacent hose elements 4, 4''''' by means of a plug-in connection.

Figure 4:
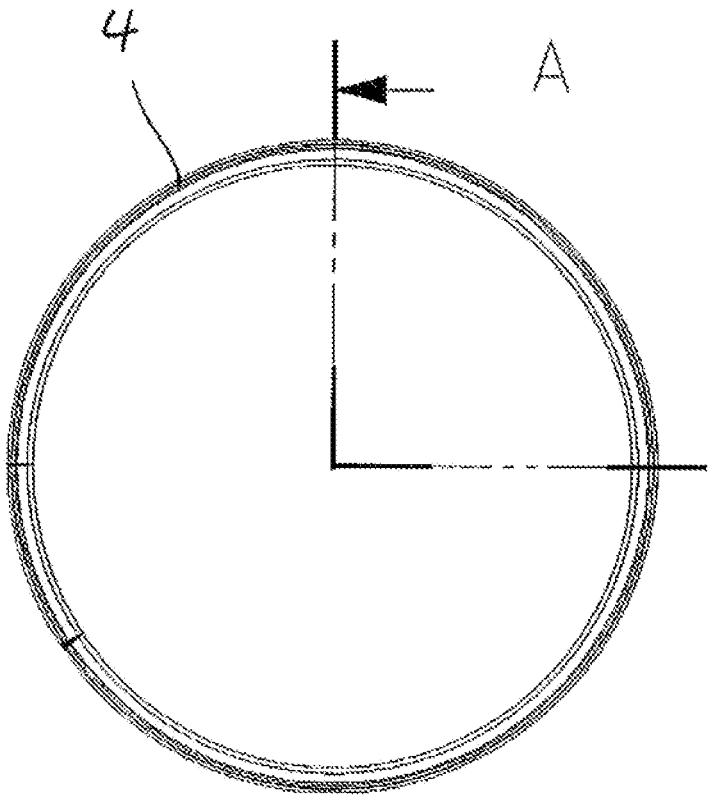
FIG. 4 shows an axial view of a hose element which is used in the hose from FIGS. 2 and 3.

The design of one of the hose elements 4 used in the hose 3 of the present exemplary embodiment is illustrated in more detail in FIGS. 4, 5 and 6. FIG. 4 here shows an axial plane view, FIG. 5 shows a side view with a partial section taken along line A, and FIG. 6 shows the detail B from FIG. 5.

As FIGS. 5 and 6 show clearly, the hose element 4 illustrated here comprises a first sub-portion 10 and a second sub-portion 11, which are both cylindrical and are connected to one another via a transition portion 12. The first sub-portion 10 has a smaller radial extent than the second sub-portion 11. The first sub-portion 10 is provided, at its end located opposite the transition portion 12, with a first end portion 13, which is radially widened and has a maximum radial extent which is somewhat smaller than the inner radial dimension of the second sub-portion 11, it therefore being possible for the first end portion 13 to slide axially within the second sub-portion 11' of an adjacent hose element.

Conversely, the second sub-portion 11 has, at its end located opposite the transition portion 12, a second end portion 14, of which the radial extent is smaller than that of the second sub-portion 11. The radial extent of the second end portion 14 is also slightly smaller than the radial extent of the first end portion 13, and a first end portion 13' of an adjacent hose element 4' can therefore interlink with the second end portion 14 such that the two end portions 13', 14 form a pull-out prevention means. At the same time, the two end portions 13', 14 are coordinated with one another such that joining forces which exceed the axial forces at play when the line element is being used as intended can be used to plug together two adjacent hose elements 4, 4' such that the two end portions 13', 14 move over one another. The rounded shape of the two end portions 13', 14 ensures a soft end stop in the extended position.

Moreover, in conjunction with the transition portion 12, the radially widened first end portion 13 ensures an axial stop when an adjacent hose element 4' is seated, by way of its first end portion 13', in the second sub-portion 11 and is moved axially further into the hose element 4. The compressed position between two hose elements 4, 4' is defined by the first end portion 13 stopping against the transition portion 12.

Therefore, a hose element 4 of a hose of the present exemplary embodiment for a line element according to the invention has a more or less S-shaped profile, as is known essentially from conventional strip-wound hoses with a hook profile. However, the hose 3 here, rather than being wound, is made up of individual ring-form hose elements 4 which are plugged one inside the other and, as FIGS. 1 and 3 show clearly, can be moved axially and/or angularly in relation to one another between a compressed position and an extended position.

The radial extents of the first end portion 13 (h1), of the transition portion 12 (h2) and of the second end portion 14 (h3) are selected in conjunction with a material thickness such that the first end portion 13 of a first hose element 4 comes into frictional contact with the inner surface of the second sub-portion 11' of a second hose element 4' and, in the compressed position, strikes against the transition portion 12' and, in the extended position, strikes against the second end portion 14'. By virtue of the hose elements 4, 4' being produced in an appropriate manner, this frictional contact can be adjusted extremely accurately to desired set-point values, and this therefore gives rise to a desirable internal friction in the made-up hose 3 and therefore to a desirable damping action in relation to the natural frequency of the bellows 1 on account of the losses associated with the internal friction. The rounded shape of the first end portion 13 makes it possible here for the internal friction to remain within the set-point values even in the case of angular movements between two hose elements 4, 4'.

Figure 4A:
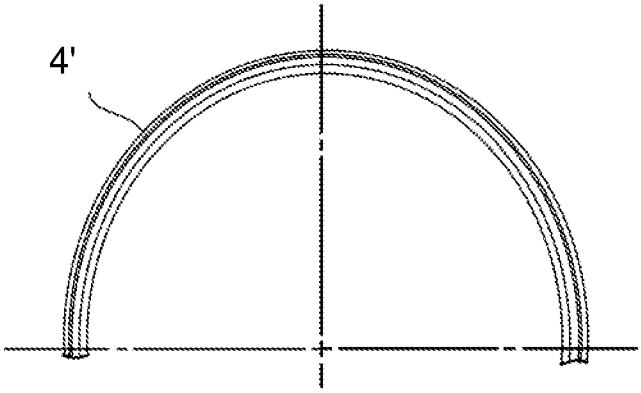
FIG. 4A schematically shows an axial view of a portion of a hose having a hose element with an oval ring shape.

FIG. 4A schematically shows that there can be a different group of hose elements 4' which have a different ring shape, and the hose 3 can be made up of different groups of hose elements 4, 4' which have different ring shapes. This may be implemented, for example, such that a first group of hose elements 4 have a circular ring shape, as shown in FIG. 4, whereas a second group of the hose elements 4' have a non-circular ring shape, in particular an oval ring shape, as shown in FIG. 4A.

Figure 7:
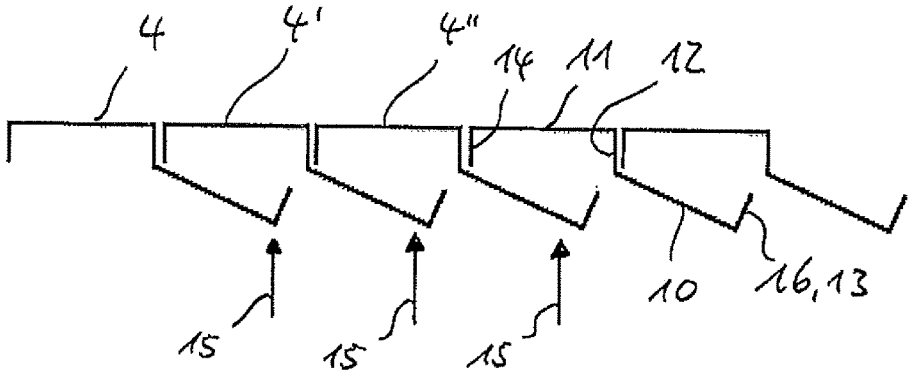
FIG. 7 shows a schematic sectional illustration of another exemplary embodiment of a hose configured according to the invention, during production thereof.
Figure 8:
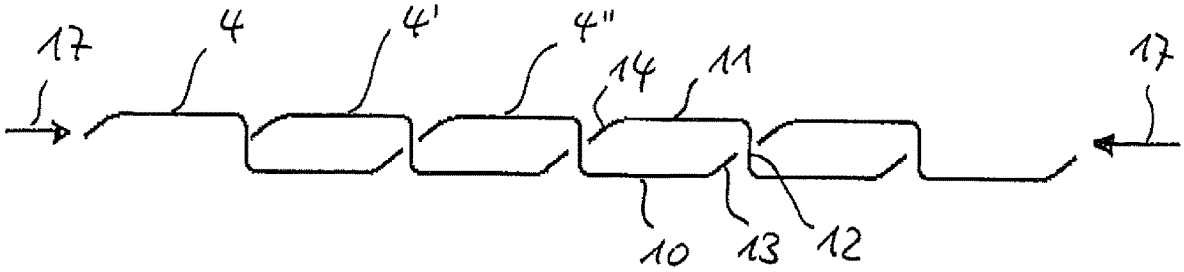
FIG. 8 shows a schematic sectional illustration of a further exemplary embodiment of a hose configured according to the invention, during production thereof.
Figure 9:
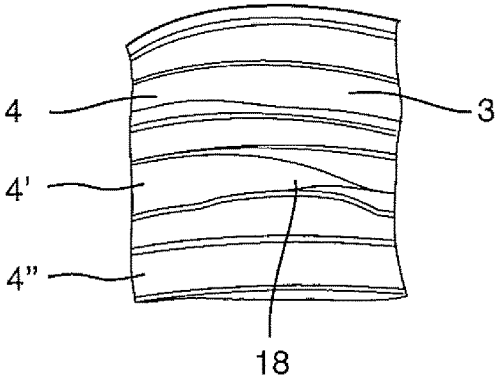
FIG. 9 shows a detail of a plan view of a hose which is configured as in FIGS. 1 to 6 and has had follow-up treatment included in its production.

FIGS. 7 to 9 use schematic illustrations to visualize examples of how a method according to the invention can be used.

FIG. 7 is a schematic sectional illustration of a row of ring-form hose elements 4, 4', 4", which have been positioned one on the other in order to be plugged one inside the other to make a hose 3. For this purpose, radially inner portions of the ring-form hose elements 4, as indicated by the arrows 15, are widened in the radially outward direction and plastically deformed to give, in the end, a hose which looks essentially like that in FIGS. 1 to 3. This is because the radially inner part of the hose elements 4, 4', 4" is provided, in an end region, with outwardly oriented angled sections 16 which, following deformation on account of the widening forces 15, form a stop surface in order to define the compressed position and the extended position of the finished hose 3.

FIG. 8 shows, once again in a schematic sectional illustration, a variant of ring-form hose elements 4, 4', 4" which, in the first instance, can be arranged, without a form fit, in a row one behind the other, and in abutment against one another, and can be plastically deformed into a hose 3 according to the invention, as is illustrated in FIGS. 1 to 3. Here too, each ring-form hose element 4 comprises a first sub-portion 10 with a radially widened, first end portion 13, a second sub-portion 11 with a second end portion 14 of reduced radial extent, and a transition portion 12, which connects the first sub-portion 10 and the second sub-portion 11.

The end portions 13, 14 here, rather than being oriented radially, taper off in a flat state, and therefore the individual hose elements 4, 4', 4" can be moved axially in relation to one another. An axial deformation force, which is indicated by arrows 17, can be used to compress, and plastically deform, the hose elements 4, 4', 4", wherein the first and second end portions 13, 14 run up against the transition portions 12 and consequently deform in such a way that they then run radially and form stop surfaces which define the compressed position and the extended position of the then finished hose 3.

Finally, FIG. 9 shows a detail of a plan view of a hose 3 configured as in FIGS. 1 to 6. The special feature of this exemplary embodiment is that, once the hose elements 4, 4', 4" have been plugged together, the hose 3 has been subjected to follow-up machining by way of the introduction of interlinking formations 18, produced by the hose elements 4 being pressed locally. Such local interlinking formations 18 restrict the movement capability of the hose elements 4, 4', 4" in relation to one another—merely locally—and therefore any rattling as a result of the hose elements 4 moving relative to one another is ruled out.

The invention claimed is:

1. A line element for compensating for at least one of expansions or relative movements within a line through which fluid can flow, the line element comprising a ring corrugation or helical-corrugation bellows (1) and a hose (3), which is arranged coaxially in an interior of the bellows (1) and is made of a dimensionally stable material, for flow guidance purposes, the hose (3) comprises a number of individual, essentially dimensionally stable ring form hose elements (4) arranged axially adjacent to one another having portions which are plugged axially one inside the other and retained together such that the hose elements (4) are movable axially in relation to one another between a compressed position and an extended position, and the hose (3) is made up of at least first and second different groups of said ring form hose elements (4), with a plurality of the hose elements being in each of the first and second different groups, the hose elements of each said group having a ring form about an axis that is different than a ring form about the axis of the hose elements of the other said group.

2. The line element as claimed in claim 1, wherein the hose elements (4) have a closed or openable circumference.

3. The line element as claimed in claim 1, wherein the first group of hose elements (4) has a circular ring shape and the second group of hose elements has a non-circular ring shape.

4. The line element as claimed in claim 3, wherein the hose (3) is made up of hose elements (4) which belong alternately to the first and the second group of hose elements.

5. The line element as claimed in claim 1, wherein in each case two adjacent ones of said ring form hose elements (4) are interlinked with one another at at least one point of circumferences thereof.

6. The line element as claimed in claim 1, wherein the bellows (1) includes axial ends, and a flange (2) on which the hose (3) is fastened is located at each of the axial ends.

7. The line element as claimed in claim 6, further comprising a clearance (8) located between the hose (4) and the bellows (1), and in a region of the flanges (2), the hose (3) has a respective hose element (4) formed as an end piece (5) that has an enlarged radial extent.

8. The line element as claimed in claim 1, wherein the hose elements (4) have, in axial sequence, a first sub portion (10) and a second sub portion (11), which are connected by a transition portion (12), and the first sub portion (10) has a radially smaller extent than the second sub portion (11).

9. The line element as claimed in claim 8, wherein, at an end of the first sub-portion (10) which is directed away from the second sub portion (11), the first sub portion (10) is provided with a radially widened, first end portion (13), and at an end of the second sub-portion (11) which is directed away from the first sub portion (10), the second sub portion (11) has a second end portion (14) of reduced radial extent, and the radial extents of the first (13) and second end portions (14) are selected such that the first end portion (13') and the second end portion (14) of two hose elements (4, 4') plugged one inside the other engage behind one another in an axial direction in order to form an axial pull out prevention arrangement and to define the extended position.

10. The line element as claimed in claim 9, wherein the radial extents of the first and second end portions (13, 14) are selected such that the first (13') and second end portions (14) of two of said hose elements (4, 4') plugged one inside the other overlap with the transition portion (12), as seen in axial projection, in order to form an axial stop, and to define the compressed position, when the two hose elements (4, 4') are pushed together.

11. The line element as claimed in claim 10, wherein at least one of the first sub portion (10) or the second sub portion (11) of one of the first and second different groups of said ring form hose elements (4) is cylindrical.

12. The line element as claimed in claim 10, wherein the first (13) and second end portions (14) are radially running angled sections of the first (10) and second (11) sub portions.

13. The line element as claimed in claim 1, wherein the hose elements (4) are produced from metal having a material thickness between 0.1 mm and 0.4 mm.

14. The line element as claimed in claim 13, wherein the hose (3) is made up of at least 3 and at most 20 hose elements (4).

15. The line element as claimed in claim 1, wherein the bellows (1) is a metal bellows and has 2 to 15 corrugations.

16. An exhaust gas system comprising the line element as claimed in claim 1.

17. The exhaust gas system of claim 16, wherein the hose (3) is located within an expansion compensation body in the exhaust system of a combustion engine, and the expansion compensation body is adapted to be arranged between a combustion engine and an emission control device.

* * * * *